US005472038A

United States Patent [19]

Forrest et al.

[11] Patent Number: 5,472,038

[45] Date of Patent: Dec. 5, 1995

[54] PRODUCTION OF SPRAY DEPOSITS

[75] Inventors: James B. Forrest, Swansea; Charles R. Pratt; Jeffrey S. Coombs, both of Neath, all of United Kingdom

[73] Assignee: Osprey Metals Limited, West Glamorgan, United Kingdom

[21] Appl. No.: 108,715

[22] Filed: Oct. 22, 1993

[30] Foreign Application Priority Data

Mar. 7, 1991 [GB] United Kingdom ..... 9104808

[51] Int. Cl.[6] ..... B22C 13/04; B22D 45/00

[52] U.S. Cl. ..... 164/46; 164/271

[58] Field of Search ..... 164/271, 46; 427/475, 427/477, 479, 480, 481, 191, 192; 239/407, 543

[56] References Cited

U.S. PATENT DOCUMENTS

| | | | |
|---|---|---|---|
| 4,681,772 | 7/1987 | Rairden, III | 427/34 |
| 4,777,935 | 10/1988 | Reichelt et al. | 164/46 |
| 4,938,275 | 7/1990 | Leatham et al. | 164/46 |

FOREIGN PATENT DOCUMENTS

| | | |
|---|---|---|
| 0244753 | 11/1987 | European Pat. Off. . |
| 1083003 | 9/1967 | United Kingdom . |
| PCTGB9200004 | 7/1992 | WIPO . |

OTHER PUBLICATIONS

Patent Abstracts of Japan, vol. 3, No. 123, Oct. 16, 1979.

*Primary Examiner*—Mark Rosenbaum
*Assistant Examiner*—I.-H. Lin
*Attorney, Agent, or Firm*—Brown, Martin, Haller & McClain

[57] ABSTRACT

A method and apparatus for the production of a deposit such as a bar (1) is provided. The deposit has a longitudinal outer surface (2) and a front face deposition surface (3). The spray deposition comprises atomized droplets produced by outer and inner sprays (4 and 5). The outer and inner sprays (4 and 5) are both directed such that, during deposition, a substantial proportion of droplets from both sprays are deposited on the front face (3) of the forming deposit. The inner spray (5) has a higher gas to metal ratio than the outer spray allowing an increase of both deposition and final product yield.

13 Claims, 1 Drawing Sheet

PRODUCTION OF SPRAY DEPOSITS

This invention relates to a method and apparatus for the production of spray deposits, particularly bar, by spray deposition of atomized metal or metal alloy.

In our prior European Publication No. 225732, we have disclosed the manufacture of bar preforms by spray deposition by the use of a single scanning atomizer. However, the production of bar preforms with a single atomizer becomes more difficult as the diameter of the bar increases due to the large scan angles and higher scanning frequencies required. Also, the centre of the spray deposited bar always cools more slowly than the surface and therefore the maximum deposition rate is usually determined by the solidification rate on the axis of the bar. Moreover, a finished deposit from high temperature alloys typically includes a porous surface layer which has to be machined away which reduced product yield.

In an attempt to overcome this problem, we have proposed the use of two or more atomizers as disclosed in our prior International Publication No. WO89/12115. In that disclosure a small diameter bar is sprayed to form a collector for a second spray, deposited some distance behind the first spray, to increase the diameter of the preform to the required final diameter. However, even in that arrangement there is a danger that there will be a trapped layer of porosity at the interface between the two deposits which will have to be removed by subsequent working.

An object of the present invention is to provide an improved method and apparatus for spray deposition of spray deposits such as bar.

According to the present invention, there is provided a method of producing an elongate spray deposit such as a round bar or billet by spray deposition comprising gas atomizing first and second streams of metal or metal alloy to form first and second sprays of atomized droplets, and depositing the atomized droplets to define a coherent elongate deposit having a longitudinal outer surface and a front face characterized in that the first and second sprays of atomized droplets are both directed such that, during deposition, a substantial proportion of droplets from both sprays are deposited on the front face of the forming deposit.

Preferably, the first and second sprays are positioned as inner and outer sprays with respect to the longitudinal axis of the deposit being formed and the inner spray has a higher gas to metal ratio than the outer spray. In this way, when the sprays comprise the same material, the atomized droplets deposited from the inner spray have a lower heat content than atomized droplets deposited from the outer spray. Preferably, the deposit is bar but the invention may be applicable to other deposits such as certain types of tube. In the preferred arrangement, the sprays overlap during deposition.

More particularly, there is provided a method of increasing deposition yield in the spray deposition of an elongate deposit and reducing surface porosity in a longitudinal surface of the deposit, the method comprising the steps of:

(a) atomizing a first stream of metal or metal alloy to form a first spray of atomized droplets;

(b) atomizing a second stream of metal or metal alloy to form a second spray of atomized droplets;

(c) co-depositing the atomized droplets of the first and second sprays on a deposition surface defined, initially by a substrate and, thereafter, by previously deposited droplets;

(d) rotating and withdrawing the substrate during deposition so that a substantially constant spray distance is maintained to the deposition surface and whereby a coherent elongate deposit having a longitudinal outer surface and a front face is formed;

(e) positioning the first and second sprays such that they form, respectively, inner and outer sprays with respect to the longitudinal axis of the deposit and during deposition, the sprays overlap and a substantial proportion of droplets from both sprays are deposited on the front face of the forming deposit; and, (f) controlling the heat content of the two sprays whereby the first spray is deposited at a lower heat content than the second spray to prevent the central portion overheating and allowing an increase in deposition yield and to reduce surface porosity in the longitudinal surface of the deposit thereby increasing overall product yield.

The sprays may be oscillated, static or a combination thereof. If the sprays are oscillated, this may be in the manner disclosed in our European Publications Nos. 0225080, 0440706 or in any other way. The metal or metal alloy of the respective streams may be the same or different.

The invention also includes apparatus for the production of an elongate deposit such as bar comprising a rotatable and withdrawable substrate, first and second gas atomizing devices for atomizing respective streams of metal or metal alloy teemed therethrough, the atomizing devices being so positioned that, in use, on rotation of the substrate, the respective sprays from the first and second gas atomizing devices overlap and may direct a substantial proportion of the atomized droplets on a front face of a coherent elongate bar deposit forming on the substrate. As in the aforementioned European Publication No. 225732, the sprays preferably are directed so that their mean axes are inclined at an acute angle to the axis of rotation of the substrate. Preferably, the respective sprays are also inclined to one another so that they converge.

However, in one arrangement, the sprays may be parallel to one another and parallel to the axis of the forming deposit, the sprays being directed at the front face.

The invention will now be described by way of example with reference to and as illustrated in the accompanying figures in which.

Figure 1:
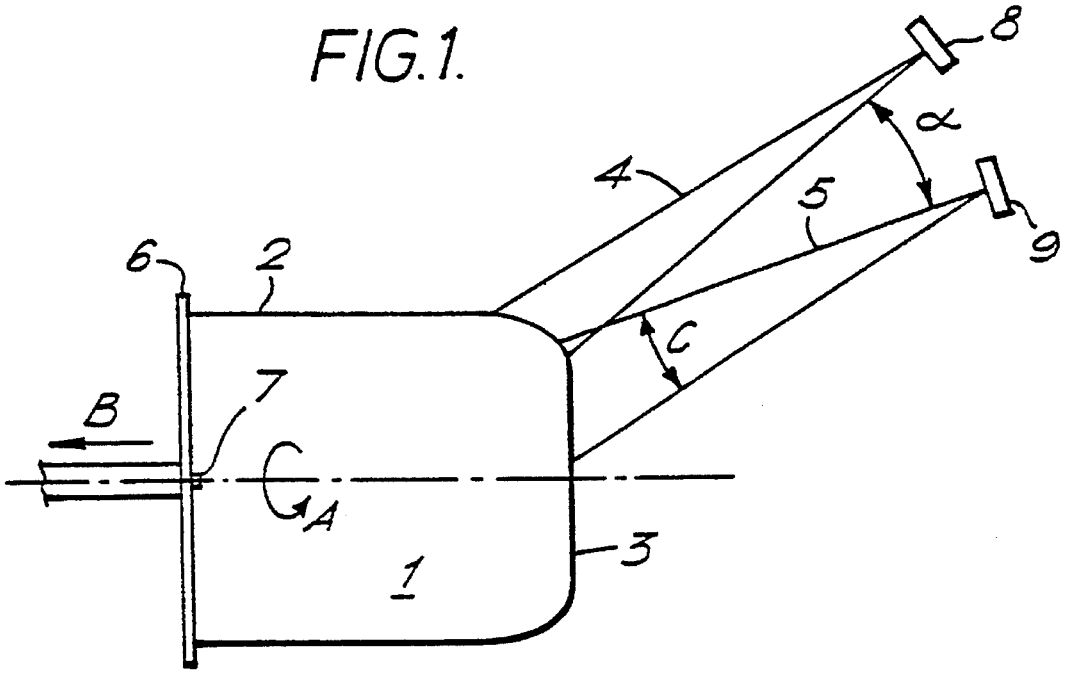
FIG. 1 is a diagrammatic view of the formation of a bar deposit in accordance with a first arrangement of the present invention.

In FIG. 1 an elongate bar deposit (1) having a longitudinal outer surface (2) and a front face deposition surface (3) is formed from the spray deposition of atomized droplets produced by two component sprays (4) and (5). The deposition process is started by deposition onto a collector (6) which is:rotated as indicated by Arrow A and which is retracted during deposition in the direction of Arrow B in order to maintain a substantially constant spray distance to the front face deposition surface (3). The surface of collector (6) may be provided with a central spigot arrangement (7) and may be roughened to facilitate keying of the initial layer of metal deposited. Thereafter, the heat extraction from the droplets of the sprays by the relatively cold gas atomizing the sprays (4) and (5) and the rate of withdrawal and rotation of the collector (6) are controlled and correlated to ensure that a coherent self-supporting deposit of substantially constant diameter is formed.

The component sprays (4) and (5) are formed by atomization of metal streams teemed from a single tundish (not shown) into respective atomizing devices (8) and (9). The atomizing devices (8) and (9) are positioned so that the sprays converge by an angle α which lies between 0° and 60° depending upon the diameter of bar deposit being formed.

In use, both component sprays (4) and (5) are directed onto the front face deposition surface (3) and overlap although the component spray (4) extends over the transition between the front face (3) and the outer surface (2) as shown. The component spray (5), being directed at a central portion of the front face (3), is scanned or oscillated to and fro as indicated by Arrow C, the component spray (4) is static. By using a static outer component spray (4) the problem of high scanning frequency is avoided and the scanning angle C of the inner component spray (5) may be maintained at a reasonable value. The overlap of the two component sprays during spraying means that the interface between the two sprays cannot be distinguished in the final deposited product and a substantially uniform structure is formed throughout the deposit.

Figure 2:
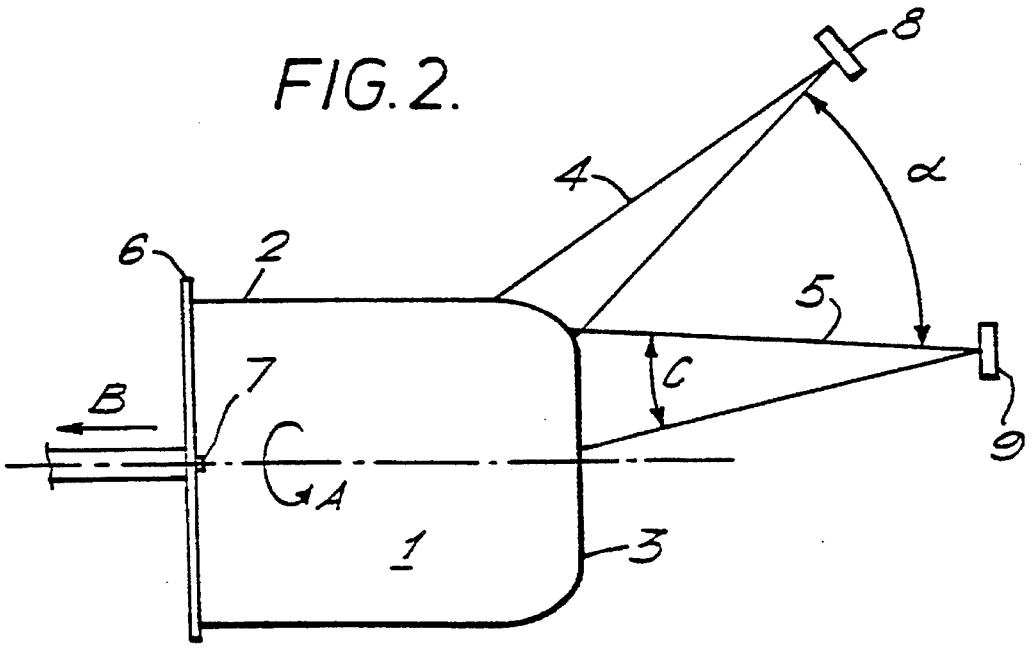
FIG. 2 is a diagrammatic view similar to FIG. 1 but of a different arrangement.

In FIG. 2, a similar arrangement is disclosed and the same references have been used. However, whereas in FIG. 1 the angle α is between 10° and 25°, in FIG. 2 the α is greater.

The use of two atomizers in accordance with the present invention has several advantages:

(i) each component spray (4) and (5) can be controlled independently. This means that the component spray (5) can be deposited using a higher gas to metal ratio allowing the central region of the bar deposit to be deposited at a lower heat content than the outer region of the bar. This prevents overheating which otherwise could lead to hotness defects such as hot tears and structure coarsening. Also, the component spray (4) may be deposited at a low gas to metal ratio, ie. the metal is deposited with a higher heat content reducing surface porosity due to excessive cooling and improving surface finish.

(ii) the deposition yield of the process may be increased. For example, experiments have shown that the yield of the process in accordance with the invention as compared to bar formed using a single atomizing device increases from approximately 70%to 80%.

(iii) the component spray (4) and (5) may include different metals or metal alloys and/or one or both of the component sprays may include ceramic particles injected into the spray, for example, into the component spray (4), to provide outer wear properties.

(iv) the overall metal flow rate is increased.

The advantages of yield were clearly seen from examination of the surfaces of 240 mm diameter sprayed bars formed in a copper alloy with single and twin atomizers. In the bar formed with a single atomizer, the surface porosity extends at least 25 mm into the bar. In the bar formed with twin atomizers, there is little or no surface porosity evident. Accordingly, whereas in the one deposit a considerable amount of material, probably 30 mm, has to be machined away before further processing, in the other, the only machining required (if any at all) is to provide the desired surface finish and therefore a maximum of only about 2 mm would need to be removed.

As an example of the present invention, there is now described a comparison of deposition conditions of the prior single atomizer arrangement with the twin atomizer arrangement of the present invention.

EXAMPLE I

| | Prior Art SINGLE ATOMIZER | Present Invention TWIN ATOMIZER |
|---|---|---|
| Alloy | Cu Cr Zr | Cu Cr Zr |
| Diameter | 240 mm | 240 mm |
| Spray Height | 450 mm | 450 mm |
| Flowrate | 30 kg/min | 40 kg/min |
| Average Gas/ Metal Ratio | 0.8 kg/kg | 0.6 kg/kg |
| Yield | 70% | 82% |
| Surface Porosity | 25 mm | 1 mm |

The principle of operation of the twin atomizer arrangement was that the inner 160 mm diameter was spray-deposited by a scanning atomizer, while a second fixed atomizer completed the outside annulus from 160 mm to 240 mm diameter, the sprays overlapping to provide a cross-over diameter of approximately 160 mm.

The resulting metal flowrates were 18 kg/min and 22 kg/min for the inner and outer atomizers respectively, while the gas/metal ratios were 0.7 kg/kg and 0.5 kg/kg.

The following Example II is an example of the formation of an AlSi deposit in accordance with the invention:

EXAMPLE II

| | |
|---|---|
| Alloy | AlSi |
| Diameter | 450 mm |
| Spray Height | 650 mm |
| Flowrate | 11.5 kg/min |
| Average G:M ratio | 3.8 kg/kg |
| Yield | 70% |
| Surface Porosity | 1 mm |

The inner 300 mm of the billet was deposited using a scanning atomizer, while a second fixed atomizer was used to deposit the outer annulus from 300 to 450 mm, causing the sprays to overlap at a cross-over diameter of approximately 300 mm.

The metal flowrates used were 5.1 kg/min and 6.4 kg/min for the inner and outer atomizers respectively, while the gas:metal ratios were 6 and 2.1 kg/kg.

The use of multiple atomizing devices has advantages in bar deposits of greater than approximately 100 mm and whether the devices are fixed or scanning depends on the diameter of the deposit. However, for smaller diameter bars, one fixed and one scanning atomizer or two fixed atomizers in accordance with the invention may be used and, for larger diameter bar, either one scanning and one fixed atomizer with an increased spray height may be used, or two scanning atomizers.

Although the invention has been described with reference to bar formation, it may also be applicable to the formation of discs, ingots, tubes and other deposits of relatively large lateral dimension. Also, although we have particularly described the use of two atomizers, the invention is applicable to the use of two or more atomizers.

In this specification, term "front face" is used to refer to an end face of a deposit transverse to an axis of the deposit. As seen from the figures, one spray—the inner spray—is directed so that substantially all of the deposited metal or metal alloy from the spray is deposited on the front face. The other spray (or the outer spray if there are more than two) is directed so that its mean axis is directed at the area of transition between the side surface and the front face, or the "corner" so that a substantial proportion of the droplets from the spray are deposited on the front face of the forming deposit.

We claim:

1. A method of producing an elongate spray deposit such as a round bar or billet by spray deposition comprising the steps of:

gas atomizing a first stream of metal or metal alloy to form a first spray of atomized droplets;

gas atomizing a second stream of metal or metal alloy to form a second spray of atomized droplets;

depositing the atomized droplets of the first and second sprays to form a coherent elongate deposit having a longitudinal outer surface and a front face;

positioning the first and second sprays to deposit a substantial proportion of the droplets from both sprays on the front face of the forming deposit;

the first and second sprays being positioned as inner and outer sprays with respect to a longitudinal axis of the deposit, and the atomized droplets of the inner spray having a lower heat content than the atomized droplets of the outer spray.

2. A method of producing a deposit according to claim 1, wherein the inner spray has a higher gas to metal ratio than the outer spray.

3. A method of producing a deposit according to claim 1, wherein the first and second sprays of atomized droplets overlap during deposition.

4. A method of producing a deposit according to claim 1, 2 or 3, wherein the first and second sprays each have a mean axis and an angle is defined between the mean axes of the first and second sprays, the angle between the mean axis of the first spray and the mean axis of the second spray being between 0° and 60°.

5. A method of producing a deposit according to claim 1, 2 or 3, wherein at least one spray is oscillated during deposition.

6. A method as claimed in claim 5, wherein both sprays are oscillated during deposition.

7. A method of producing bar according to claim 1, comprising depositing the atomized droplets on a substrate and subsequently the surface of previously deposited droplets, rotating and withdrawing the substrate during deposition so that a substantially constant spray distance is maintained to the deposition surface, and controlling the extraction of heat from the atomized droplets and the rate of rotation and withdrawal of the deposition surface such that a coherent elongate deposit is formed with the deposition surface defining the front face thereof.

8. A method of producing bar according to claim 7, wherein the first spray is directed at a central portion of the front face of the forming bar and the second spray is directed at an outer region of the front face of the forming bar.

9. A method as claimed in claim 7 or claim 8, wherein the first and second sprays are static.

10. A method as claimed in claim 7 or claim 8, wherein the first and second sprays are a combination of oscillated and static sprays.

11. A method of producing bar according to claim 7 or 8, wherein the first and second sprays are oscillated.

12. A method of producing a deposit in accordance with claim 1 wherein the metal or metal alloy of the respective streams is of the same composition.

13. A method of increasing deposition yield in the spray deposition of an elongate deposit and reducing surface porosity in a longitudinal surface of the deposit, the method comprising the steps of:

(a) atomizing a first stream of metal or metal alloy to form a first spray of atomized droplets;

(b) atomizing a second stream of metal or metal alloy to form a second spray of atomized droplets;

(c) co-depositing the atomized droplets of the first and second sprays on a deposition surface defined, initially by a substrate and, thereafter, by previously deposited droplets;

(d) rotating and withdrawing the substrate during deposition so that a substantially constant spray distance is maintained to the deposition surface and whereby a coherent elongate deposit having a longitudinal outer surface and a front face is formed;

(e) positioning the first and second sprays such that they form, respectively, inner and outer sprays with respect to the longitudinal axis of the deposit and during deposition, the sprays overlap and a substantial proportion of droplets from both sprays are deposited on the front face of the forming deposit; and, (f) controlling the heat content of the two sprays whereby the first spray is deposited at a lower heat content than the second spray to prevent the central portion overheating and allowing an increase in deposition yield and to reduce surface porosity in the longitudinal surface of the deposit thereby increasing overall product yield.

* * * * *